US005995065A

United States Patent [19]

Kitchener et al.

[11] Patent Number: 5,995,065

[45] Date of Patent: Nov. 30, 1999

[54] DUAL RADIO ANTENNA

[75] Inventors: Dean Kitchener, Brentwood; Julius George Robson, Great Dunmow, both of United Kingdom

[73] Assignee: Nortel Networks Corporation, Richardson, Tex.

[21] Appl. No.: 08/936,314

[22] Filed: Sep. 24, 1997

[51] Int. Cl.[6] ..... H01Q 1/36; H01Q 9/04

[52] U.S. Cl. ..... 343/895; 343/791; 343/752

[58] Field of Search ..... 343/725, 729, 343/745, 752, 895, 790, 791, 792

[56] References Cited

U.S. PATENT DOCUMENTS

| | | | |
|---|---|---|---|
| 4,509,056 | 4/1985 | Ploussios | 343/791 |
| 4,647,941 | 3/1987 | Myer | 343/792 |
| 4,658,260 | 4/1987 | Myer | 343/792 |
| 4,829,316 | 5/1989 | Nakasa et al. | 343/792 |
| 4,940,989 | 7/1990 | Austin | 343/749 |
| 5,311,201 | 5/1994 | Lillie et al. | 343/791 |
| 5,416,490 | 5/1995 | Popovic | 343/700 MS |

FOREIGN PATENT DOCUMENTS

| | | |
|---|---|---|
| 0590534 A1 | 4/1994 | European Pat. Off. . |
| 0650215 A2 | 4/1995 | European Pat. Off. . |
| 0791977 A2 | 8/1997 | European Pat. Off. . |
| 3732994 A1 | 4/1989 | Germany . |
| WO97/12417 | 4/1997 | WIPO . |

OTHER PUBLICATIONS

Colloquium on Design of Mobile Handset Antennas for Optimal Performance in the Presence of Biological Tissue—Reference No. 1997/022.

A Wideband Dual Meander Sleeve Antenna—M Ali et al.

*Primary Examiner*—Hoanganh Le
*Assistant Examiner*—Jennifer H. Malos
*Attorney, Agent, or Firm*—John D. Crane

[57] ABSTRACT

This invention relates to an antenna operable in a multi-mode radio transceiver. One aspect of the present invention, provides a radio antenna having resonant frequencies operable to receive and transmit radio signals in different frequency bands according to two operating protocols.

4 Claims, 12 Drawing Sheets

DUAL RADIO ANTENNA

FIELD OF THE INVENTION

The present invention relates to radio antennas and, in particular, relates to the same for use in a dual mode mobile radio handset.

BACKGROUND ART

Personal communication networks are being deployed extensively world-wide using cellular mobile radio systems. Earlier networks, still in operation, use analogue modulation formats for the radio air interface protocol. These analogue networks exhibit the problem of call saturation in high usage areas. To overcome this problem higher capacity air interface protocols using digital modulation format networks have been introduced in tandem, that is an area is covered by both systems.

In the United States and Canada the early standardised analogue network known as AMPS has reached a fairly universal coverage of the populated North American continent. The newer digital networks, however, tend to be deployed in areas of high usage. A result of this is that there are areas of digital network coverage overlaying a universal analogue network coverage. Additionally, different air interface protocol standards of digital networks have been deployed regionally, since different telecommunications operators have developed their own protocols or have developed such protocols in line with national and sometimes international standards authorities, for example, the GSM protocol. Whilst it is reasonable to suppose that handsets operable for different radio communications protocols are similar from the users point of view, it is not possible, in particular, to use a digital mobile radio in an analogue cellular region and vice versa. This stems from the fact that whilst both types of handsets possess antennas, radio front end transmitter, receiver and baseband circuits, they operate on different air interface protocols which operate, inter alia at different radio carrier frequencies.

Therefore it can be seen that each individual personal communications system user will need a dual network service for complete coverage. Consequently the user requires a handset that will not only function throughout the coverage area of the specific subscribed-to digital network, but also have a switched alternative mode to operate on the universal analogue network.

The problem of implementing a dual mode handset has been considered to be surmountable by several different approaches; one solution uses two separate radio transceivers piggybacked and combined at the man-machine interface (keyboard and audio); a second solution uses two separate radio sections piggybacked and combined at the digital signal processing part of the radio transceiver, —applicants have a pending application relating to such a scheme, GB9603316.2. These two above approaches have problems in that both modes of operation transmit via an antenna. If the frequencies of operation are different, as indeed they will need to be, then two types of antenna will be necessary.

For a dual mode terminal perhaps the simplest option for the antenna is to use a separate element for each of the desired bands. This could be in form of one external and one internal antenna, or two internal antennas. Two external antennas would be cumbersome, and unsightly. Such use of two antennas which have separate resonant frequencies of operation is accordingly complicated and unwieldy.

For the case where one external and one internal antenna is used it may be better to use the internal antenna to serve the higher frequency band. This keeps the size of the internal antenna down, thus ensuring that the volume required for the antenna inside the handset is kept to a minimum. For the external antenna a standard extractable monopole could be used, with a helix on the end for when the antenna is retracted. Alternatively, a fixed external antenna could be used. For the internal antenna a bent folded monopole could be employed. However, bent folded monopole elements do not provide sufficient bandwidth; for a typical, efficient bent folded monopole element one night expect a 5–7% 10 dB return loss bandwidth.

A number of dual band helical structures have been investigated at the Helsinki University of Technology, and these were presented at the 1996 IEEE VTC Conference. The helical structures presented are shown in FIG. 1. They consist of: (a) two helical antennas, one within the other; (b) a helical-monopole combination; and (c) a helical antenna combined with a wound monopole. The paper states that the dual frequency operation can be obtained from all three of the structures that are shown. Results for structure (a) state that it was tuned to the frequencies 1740 MHz and 900 MHz, and that 10 dB return loss bandwidths were obtained of 5.2% and 2.2% respectively. The dimensions for the antenna were $D_1$=6 mm, lh1–12 mm, $N_1$=5, $D_2$–3 mm, $l_{h2}$=14 mm, $N_2$=5, and $1_s$=10 mm. Results for structure (b) state that it was tuned to the frequencies 1750 MHz and 894 MHz, and that 10 dB return loss bandwidths were obtained of 12% and 4.5% respectively. Structure (c) is simply a more compact version of (b), and not surprisingly has a narrower bandwidth. For the upper and lower bands, measured bandwidths of 11% and 2.9% were obtained where the overall structure height was 34 mm. Thus, in summary these antennas provide a bandwidth which is not sufficient for many radio applications, and also does not leave any margin for manufacturing tolerances.

A dual band external antenna is described by Ali et al in 'A wide band dual meander sleeve antenna', IEEE Antennas and Propagation Society International Symposium, 1995, vol.2 p.1124–7, Jun. 18–23, 1995, Newport Beach, Calif., USA, and this is called the wide band dual meander sleeve antenna. This antenna is described as potentially useful as a low profile antenna for a dual mode handset. However, the results presented in the paper are for the case where the experimental antenna is mounted on a large ground plane (90 $cm^2$).

One possible configuration for a combination of antenna elements could be a monopole used to serve the AMPs radio, and an internal bent folded monopole used to serve the PCS radio. Disadvantages arising from such a configuration are: the SAR performance may be unacceptable; the monopole is susceptible to damage/breakage; and, Isolation may be poor.

A still further option is the use of a single antenna structure which is combined with a dual band matching network, but this is also complicated and unwieldy.

OBJECT OF THE INVENTION

Accordingly, it is an object of the present invention to overcome the aforementioned problems.

STATEMENT OF THE INVENTION

In accordance with one aspect of the present invention, there is provided a radio antenna having resonant frequencies operable to receive and transmit radio signals in different frequency bands according to two operating protocols.

In accordance with another aspect of the invention, there is provided a dual resonance radio antenna operable at two wavelengths $\lambda_1$ and $\lambda_2$, where $\lambda_1$ corresponds to the higher frequency, comprising a first monopole element having a length corresponding to a quarter of the wavelength of the lower operating frequency and a cylindrical element comprising a coaxial stub which surrounds the first monopole element having an electrical length corresponding to $\lambda_1/4$ the cylindrical portion being electrically connected at the top of the monopole, providing the monopole with an exposed $\lambda_1/4$ length between the stub and a base of the antenna; wherein at the lower operating frequency, current is induced on the outer surface of the coaxial stub which is in phase with the exposed $\lambda_1/4$ section and the antenna performs as a quarter wave monopole; and wherein at the higher operating frequency the stub presents a high impedance at the top of the monopole whereby the effective length of the monopole is $\lambda_1/4$, as measured from the base of the antenna.

Advantageously, the coaxial region of the stub is partially or completely filled with dielectric.

In accordance with a further aspect of the invention, there is provided a method of operating a dual resonance radio antenna operable at two wavelengths $\lambda_1$ and $\lambda_2$, where $\lambda_1$ corresponds to the higher frequency, the antenna comprising a first monopole element having a length corresponding to a quarter of the wavelength of the lower operating frequency and a cylindrical element comprising a coaxial stub which surrounds the first monopole element having an electrical length corresponding to $\lambda_1/4$ the cylindrical portion being electrically connected at the top of the monopole, providing the monopole with an exposed $\lambda_1/4$ length between the stub and a base of the antenna; wherein at the lower operating frequency, current is induced on the outer surface of the coaxial stub which is in phase with the exposed $\lambda_1/4$ section and the antenna performs as a quarter wave monopole; and wherein at the higher operating frequency the stub presents a high impedance at the top of the monopole whereby the effective length of the monopole is $\lambda_1/4$, as measured from the base of the antenna.

BRIEF DESCRIPTION OF DRAWINGS

In order that greater understanding of the invention be attained, an embodiment of the invention will now be described with reference to the accompanying drawings, wherein:

FIG. 2 shows a block diagram of a typical cellular radio handset. Radio frequency signals are received and transmitted by the antenna 2 which is connected to a radio front end 4. In the radio front end transmit and receive signals are converted between radio frequency and base band, whereby digital signal processing means 6 encode the transmit and decode the receive signals and from these can determine the audio signals which are communicated to and from the handset user by loudspeaker 7 and microphone 8. The front end will typically contain transmit and receive paths which are mixed to an intermediate frequency with a local oscillator. These intermediate frequency signals will be further processed and mixed so that the input and output signals to and from the front end are at baseband and suitable for digital to analogue or analogue to digital conversion, as appropriate, prior to digital signal processing.

Referring now to FIG. 3, there is shown a handset architecture, comprising a dual mode radio front end for the reception of both digital PCS 1900 signals and analogue AMPS signals. PCS 1900 operates in the frequency band 1930 to 1990 MHz on the receive downlink to the handset and in the 1850 to 1910 MHz band on the transmit uplink from the handset. AMPS operates in the frequency band 824 to 849 on the transmit uplink from the handset and in the 869 to 894 MHz band on the receive downlink to the handset.

Figure 1A:
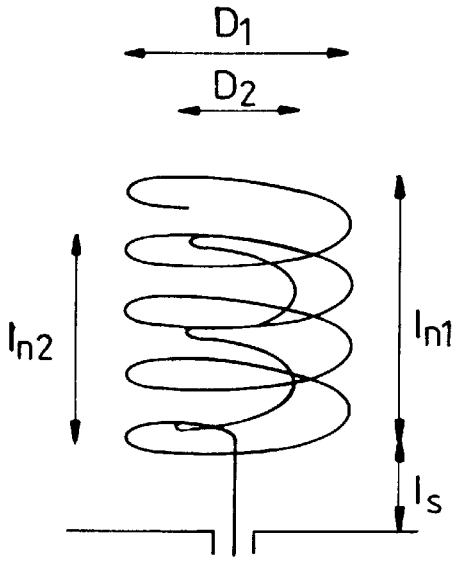
FIG. 1 depicts three dual frequency antenna configurations.
Figure 1B:
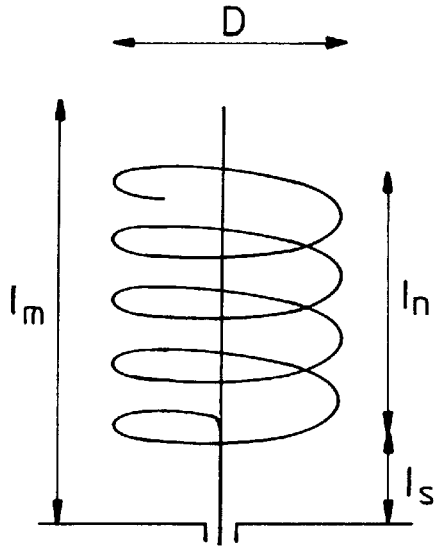
Figure 1C:
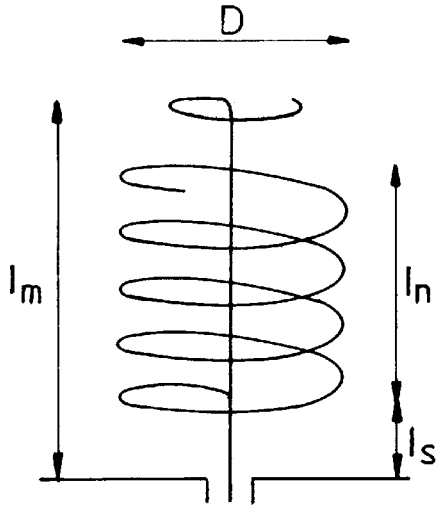
Figure 2:
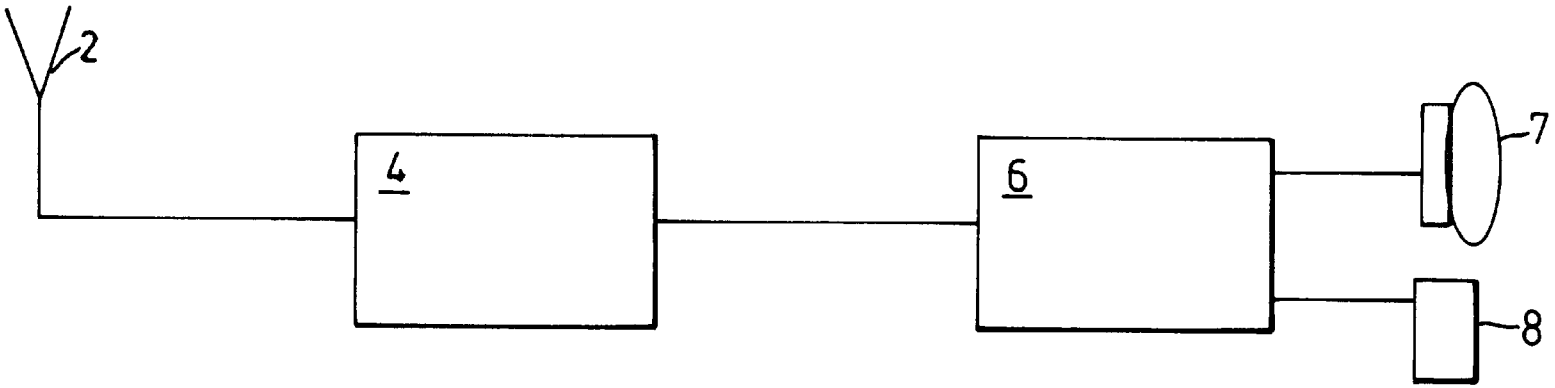
FIG. 2 depicts a typical handset schematic.
Figure 3:
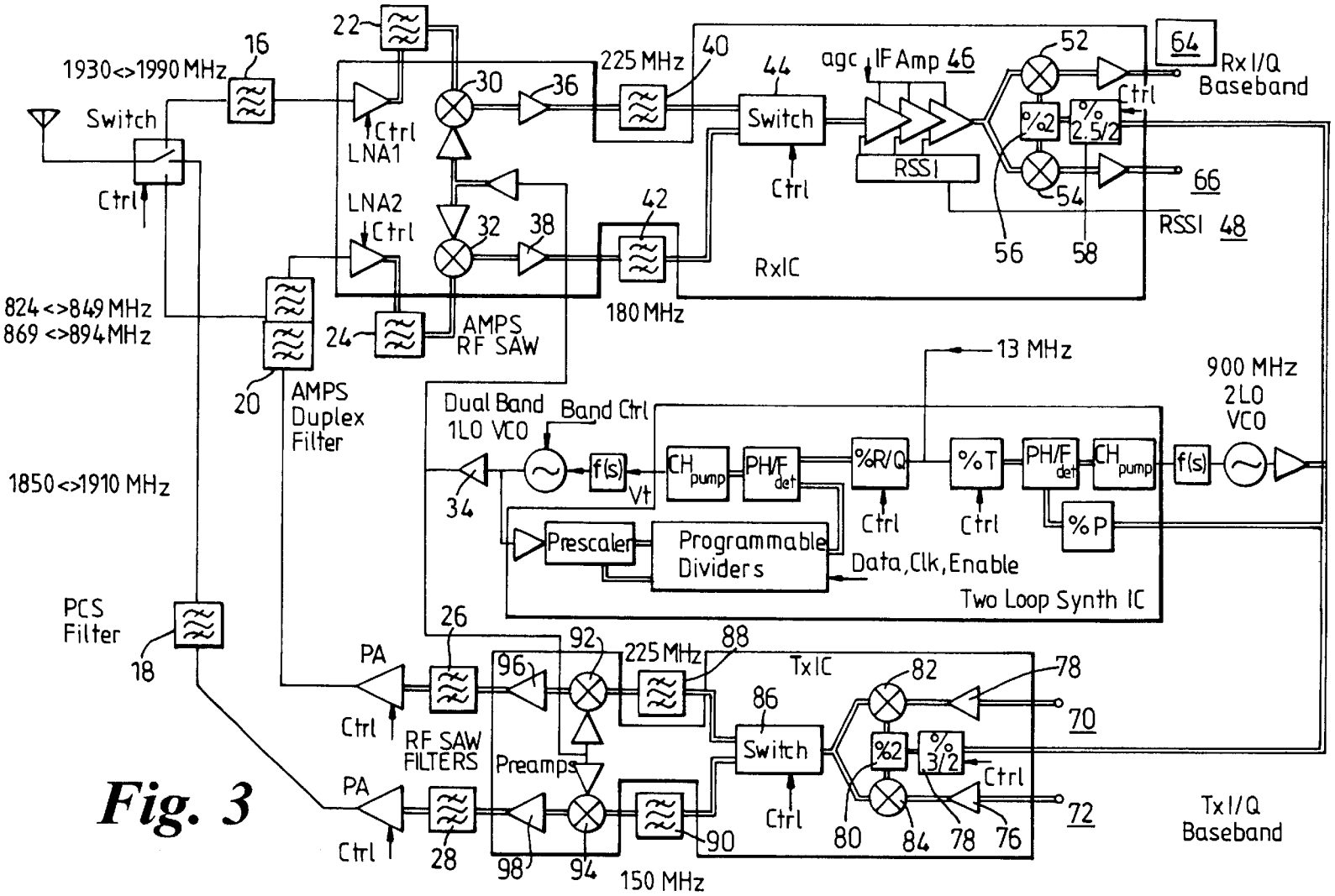
FIG. 3 is a detailed implementation of a dual mode radio front end.

PCS 1900 operates either in an uplink mode or in a downlink mode; AMPS can operate in both modes simultaneously. For this reason the switch 14 from the antenna 12 has three positions. Details of the antenna are not shown in this figure for simplicity.

Turning now to the receive path for the digital PCS 1900 signals, when the switch 14 directs incoming digital PCS 1900 signals to the PCS 1900 receive path, the signals from the band select filter 22 are passed to a mixer 30 which mixes the received signal with a signal from a synthesised local oscillator 34 to produce an intermediate frequency (IF) signal at 225 MHz which is subsequently amplified by further amplifying means 36. The PCS 1900 signals are passed through a second switching circuit 44 which operates simultaneously with the first switch 14 by mode control means (not shown).

The mode control means identifies whether the signals are digital or analogue modulation and determines in which mode the transceiver is operating. The receive signal output from which 44 is fed to an IF amplifier with automatic gain control and a receive signal strength indicator (RSSI). If an analogue AMPS radio signal were present at the antenna and a decision made to receive that signal, the switch 14 would feed the signal from the antenna 12. For transmit, the PCS 1900 and AMPS baseband signals are raised to 150 MHz and 225 MHz intermediate frequencies (IFs) respectively. The upconverted IF containing either the PCS 1900 signal at 150 MHz or the AMPS signal at 225 MHz is applied respectively to the PCS 1900 transmit band at 1850 to 1910 MHz and the AMPS transmit band at 824 to 849 MHz. The respective signals are RF band filtered by 26 and 28 prior to power amplification and then fed to the antenna via separate filters and switch 14.

The main factors that should be taken into account in the design of an antenna are electrical performance, volume required (internally), cost, and manufacturability. With regard to the electrical performance of antennas, the main performance parameters are: radiation efficiency; isolation (where two elements are used); typically the return loss should be >10 dB across the operating band. Thus the PCS antenna requires a 7.3% 10 dB return loss bandwidth, while the AMPS antenna requires and 8.1% bandwidth. Mean effective gain is a measure of the handset antenna radiation pattern, and involves the multi-path angular density function. SAR is fixed by regulatory limits. Radiation efficiency, this should be greater than −2 dB for the handset in isolation (ideally >−1 dB for external antennas). With the handset in the presence of the head and hand the efficiency should be >−3 dB. The isolation required between two antenna elements ought to be >10 dB, since if the coupling is too high this can result in a significant reduction in efficiency.

Figure 4:
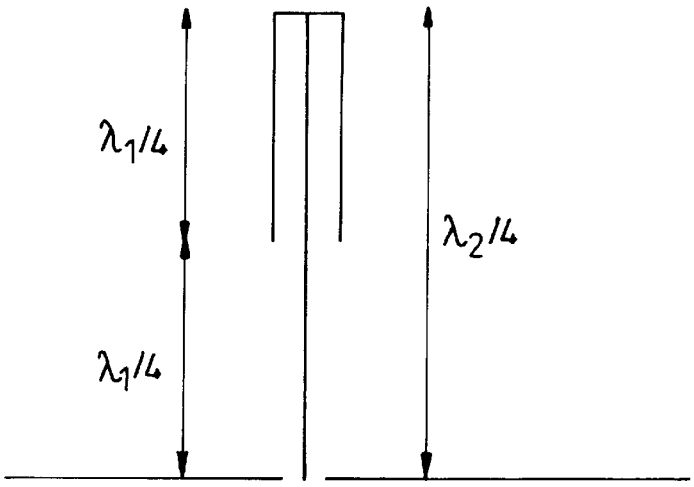
FIG. 4 is a schematic diagram of a dual band monopole structure made in accordance with the invention.

Referring now to FIG. 4, a schematic diagram of a dual band monopole structure made in accordance with the invention is shown. The wavelengths for the two resonances are given by $\lambda_1$ and $\lambda_2$, where $\lambda_1$ corresponds to the higher frequency. At the higher frequency the antenna simply looks like a quarter wave monopole. This is because there is a $\lambda_1/4$ coaxial stub at the top of the initial $\lambda_1/4$ 'monopole'. The stub is short-circuited at one end, presenting an open circuit at the top of the monopole. For the lower frequency, current is induced on the outer surface of the coaxial stub which is in phase with the lower $\lambda_1/4$ section. The overall height is $\lambda_2/4$ and so a second resonance is generated. By the use of a dielectric loading, the second section of the antenna can be varied in length.

Figure 5:
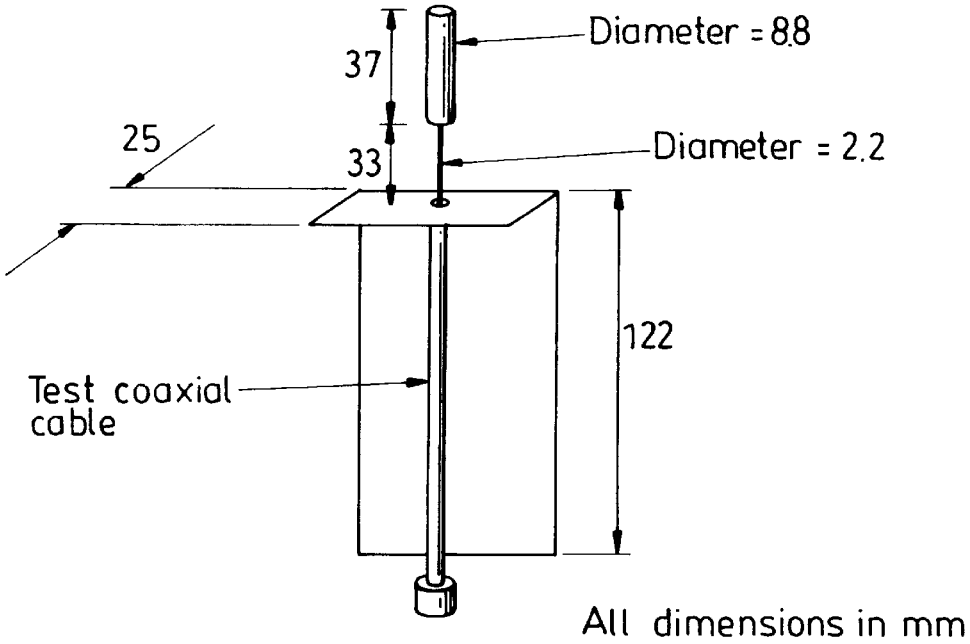
FIG. 5 is a first embodiment of an antenna made in accordance with the invention.
Figure 6:
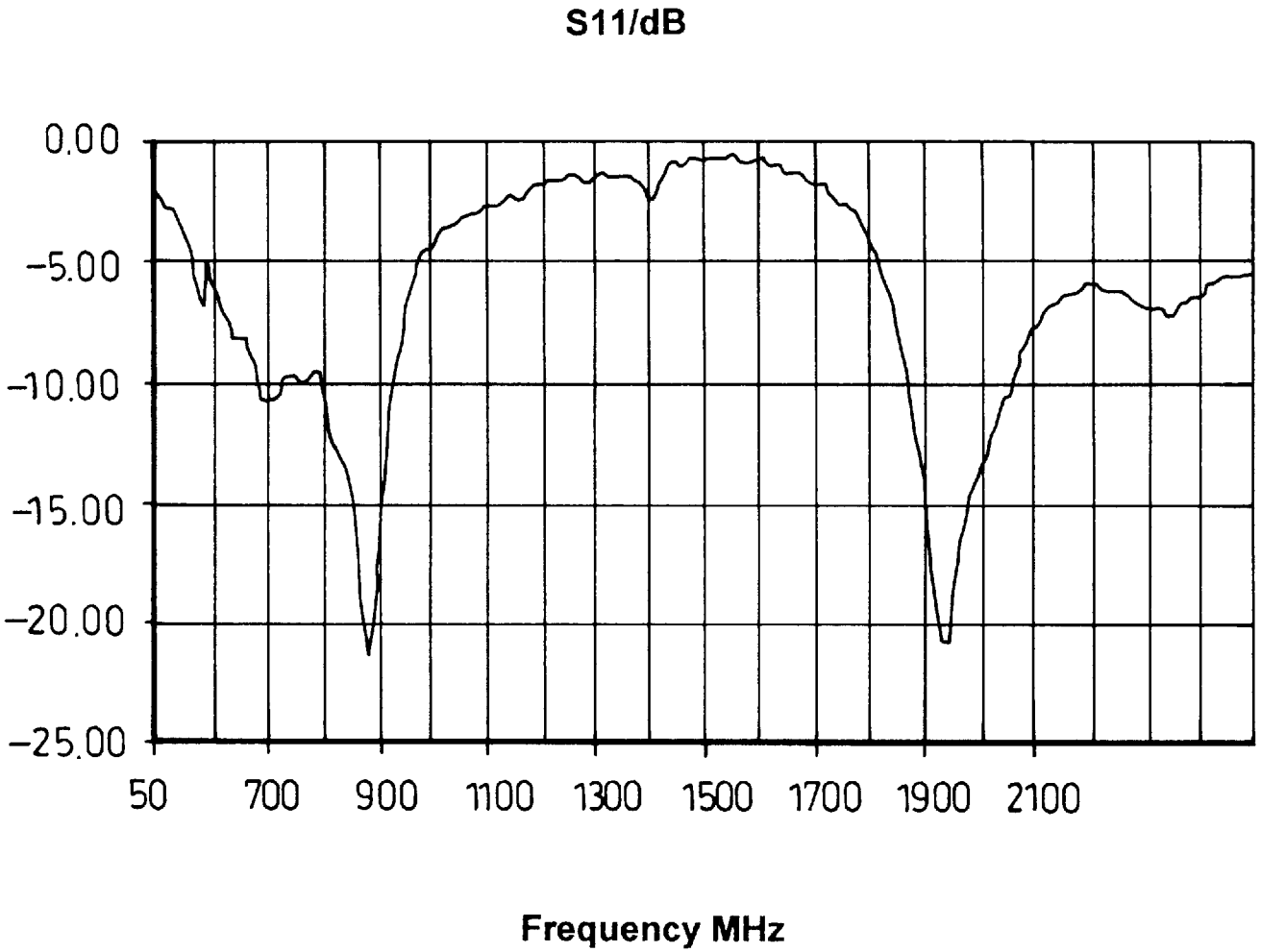
FIG. 6 shows the measured return loss for the dual frequency monopole prototype shown in FIG. 5.

The dimensions of one antenna are shown in FIG. 5. The antenna was mounted on a rectangular PCB with dimensions comparable to a standard handset. The measured return loss is shown in FIG. 6. For the lower resonance the 10 dB return loss bandwidth is 800–930 MHz. The centre of this band is 865 MHz, and using this centre frequency the percentage bandwidth is 15%. Note that the AMPS band (824–894 MHz) is accommodated within this bandwidth. For the upper resonance the 10 dB return loss bandwidth is 1870–2050 MHz. The centre of this band is 1960 MHz, and using this centre frequency the percentage bandwidth is 9.2%. While this bandwidth is adequate for the PCS 1900 band (1850–1990 MHz), some slight retuning is required, which would involve a small lengthening of the 33 mm monopole section shown in FIG. 6.

Figure 7:
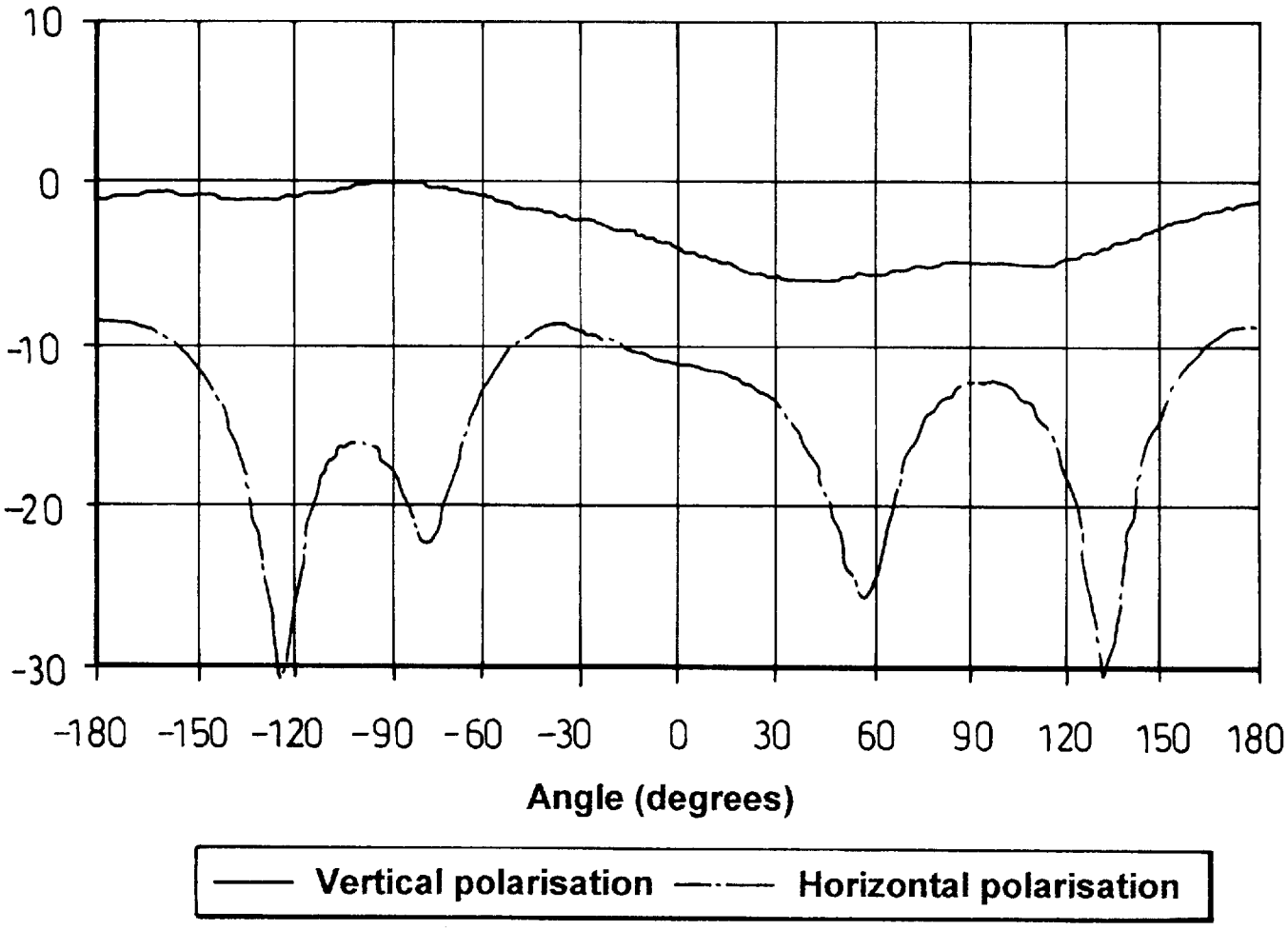
FIG. 7 shows the measured azimuth radiation pattern for the dual band monopole shown in FIG. 5 at 900 MHz.
Figure 8:
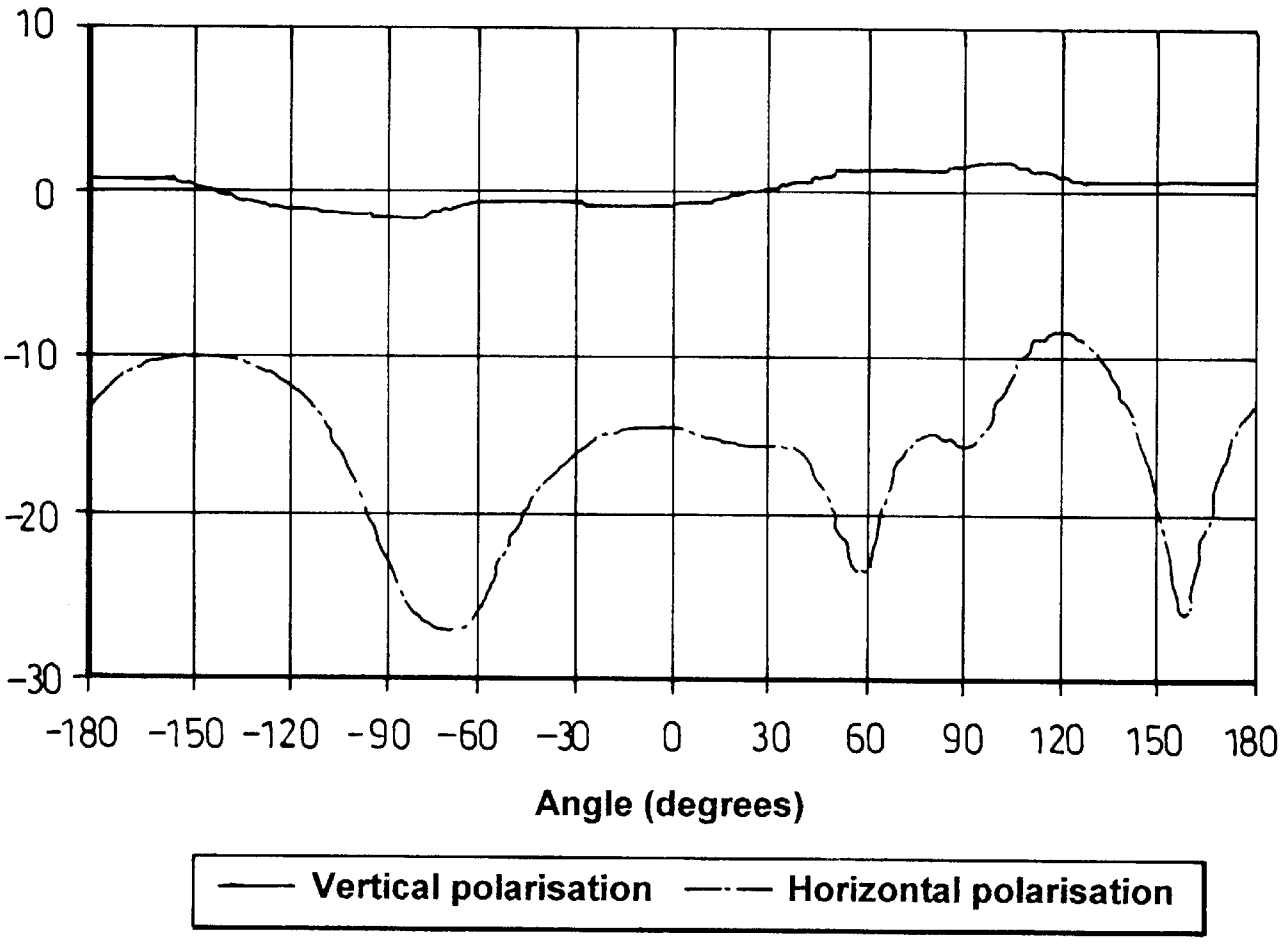
FIG. 8 shows the measured azimuth radiation pattern for the dual band monopole shown in FIG. 5 at 1900 MHz.

The measured azimuth radiation patterns at 900 MHz and 1900 MHz are shown in FIGS. 7 and 8. The measured azimuth gain is quite low at 900 MHz, and further measurements are required to determine the antenna efficiency, and elevation patterns in the two bands. The elevation pattern for 900 MHz may well be down tilted.

At the lower frequency, the overall structural length is designed to be nominally equivalent to a quarter of a wavelength long. This is where the reason for the choice of the frequency ratio of two becomes apparent: it is a quarter of the wavelength at the higher frequency. Unfortunately, the stub cannot be ignored. This is now an eighth wavelength short circuited stub which results in an inductive reactance at the open end. Consequently, the structure looks like a quarter wavelength monopole with an inductive reactance at its centre. This affects the input impedance such that some matching is required.

Figure 9:
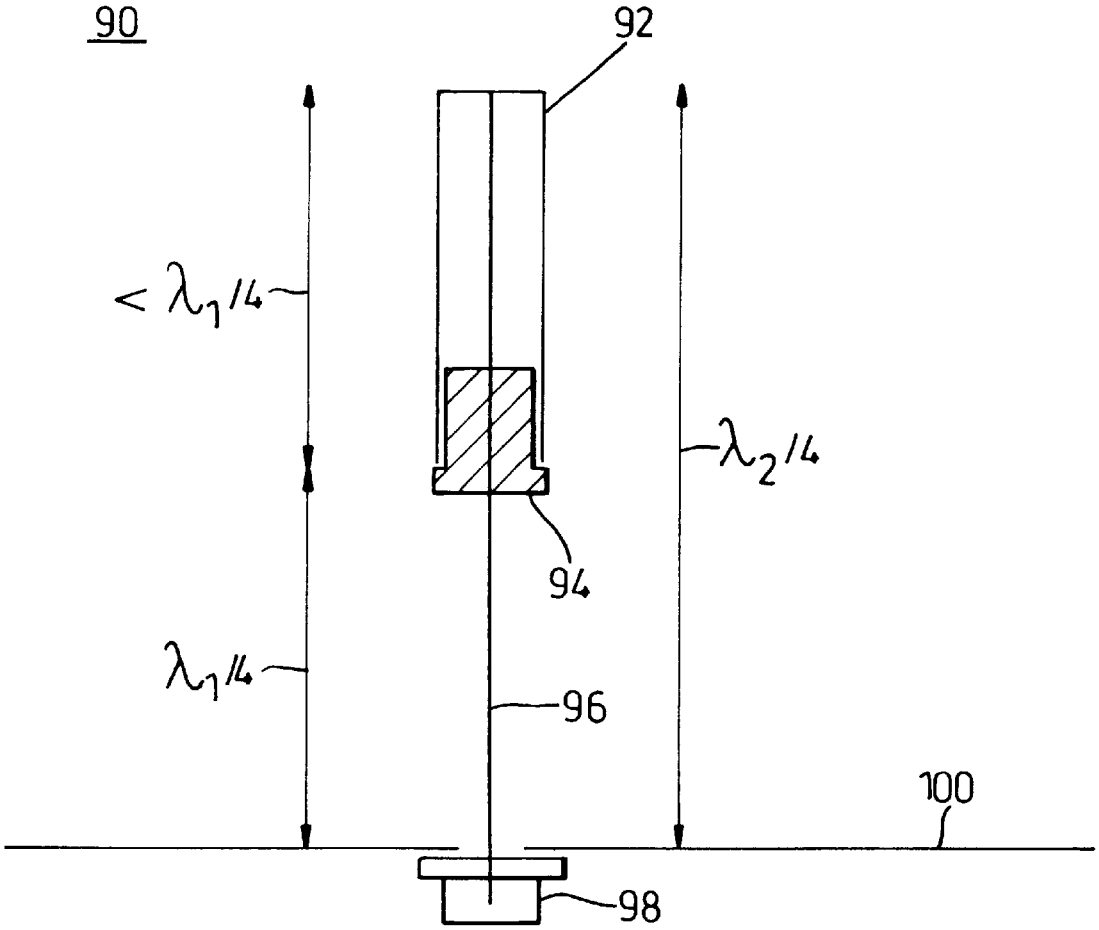
FIG. 9 is a schematic diagram of a second embodiment of an antenna made in accordance with the invention.
Figure 10:
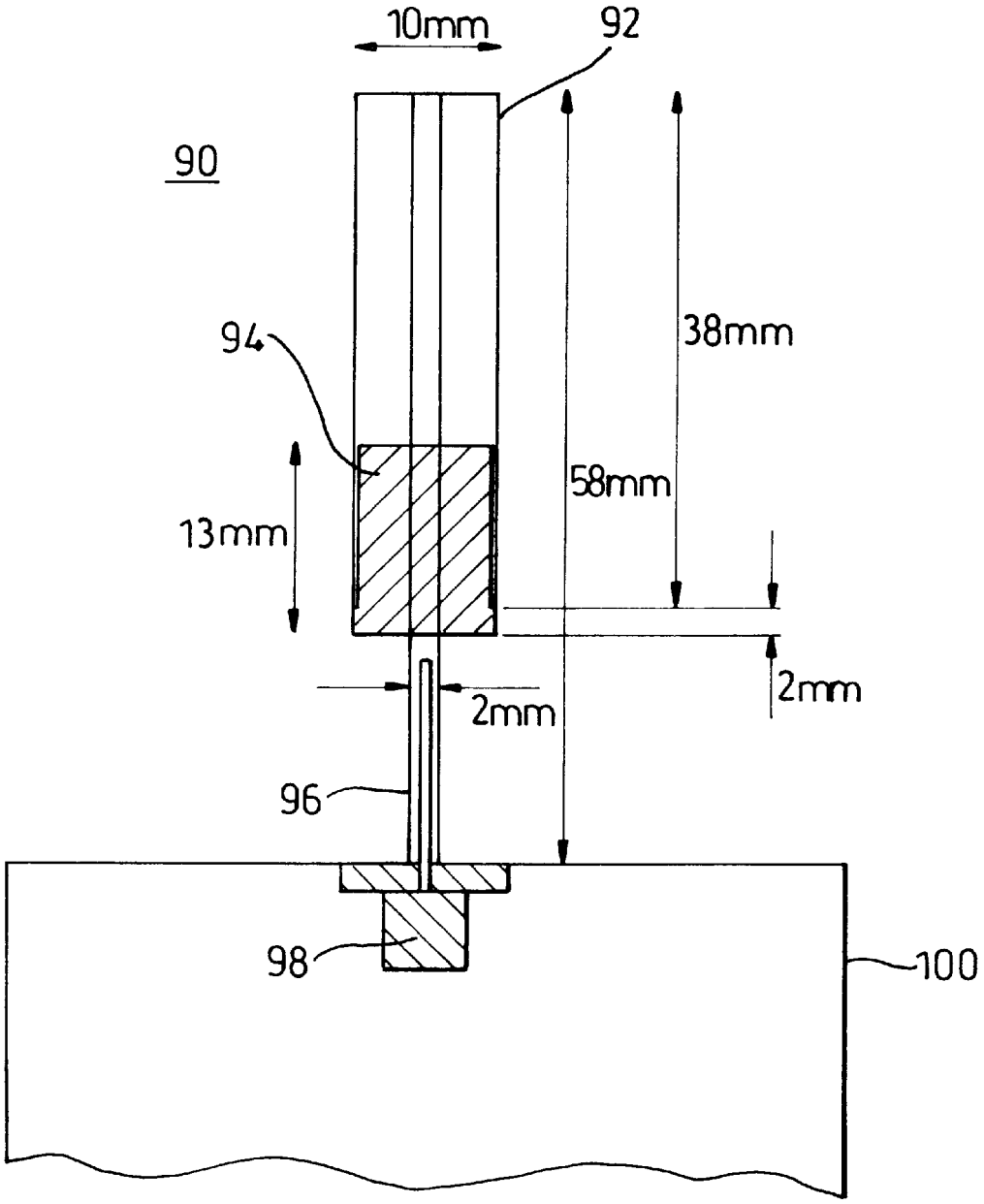
FIG. 10 shows the dimensions of a second embodiment of an antenna made in accordance with the invention.

There are two ways of overcoming this: either a match can be placed on the board which is inconvenient, or the stub can be partially dielectrically loaded which changes the reactive component in the coaxial region but does not affect the outside whereby the structure can fairly easily empirically be matched. FIG. 9 shows a second embodiment 90 with a 1 mm thick tube 92, closed at a distal end and having a PTFE plug 94 inserted at the open end, a copper tube 96 extending from a sma connector 98 mounted on a ground portion, such as a mobile phone case, 100. There is no d.c. connection between the tube 96 and the case 100. The tube could be replaced with a solid element: alternatively the antenna structure could be made flexible. FIG. 10 shows the physical dimensions of an embodiment. The flange of the dielectric protrudes by 2 mm in the example shown. This enables the structure to be self-locating since it ensures that the dielectric extends to a particular depth inside the structure. Nevertheless, it could be flush.

The coaxial region can also be fully dielectrically loaded but the electrical length would be changed, which would require a shortening of the coaxial region, but it shortens the whole structure. It does nothing to change the length of the intermediate portion operable at the highest frequency because the open circuit still exists. By increasing the lowest frequency some control over the frequency ratio can be obtained. This allows a consequential flexibility in frequency ranges so that frequency combinations such as GSM and DECT, AMPS and PCS 1900, can be covered.

Figure 11:
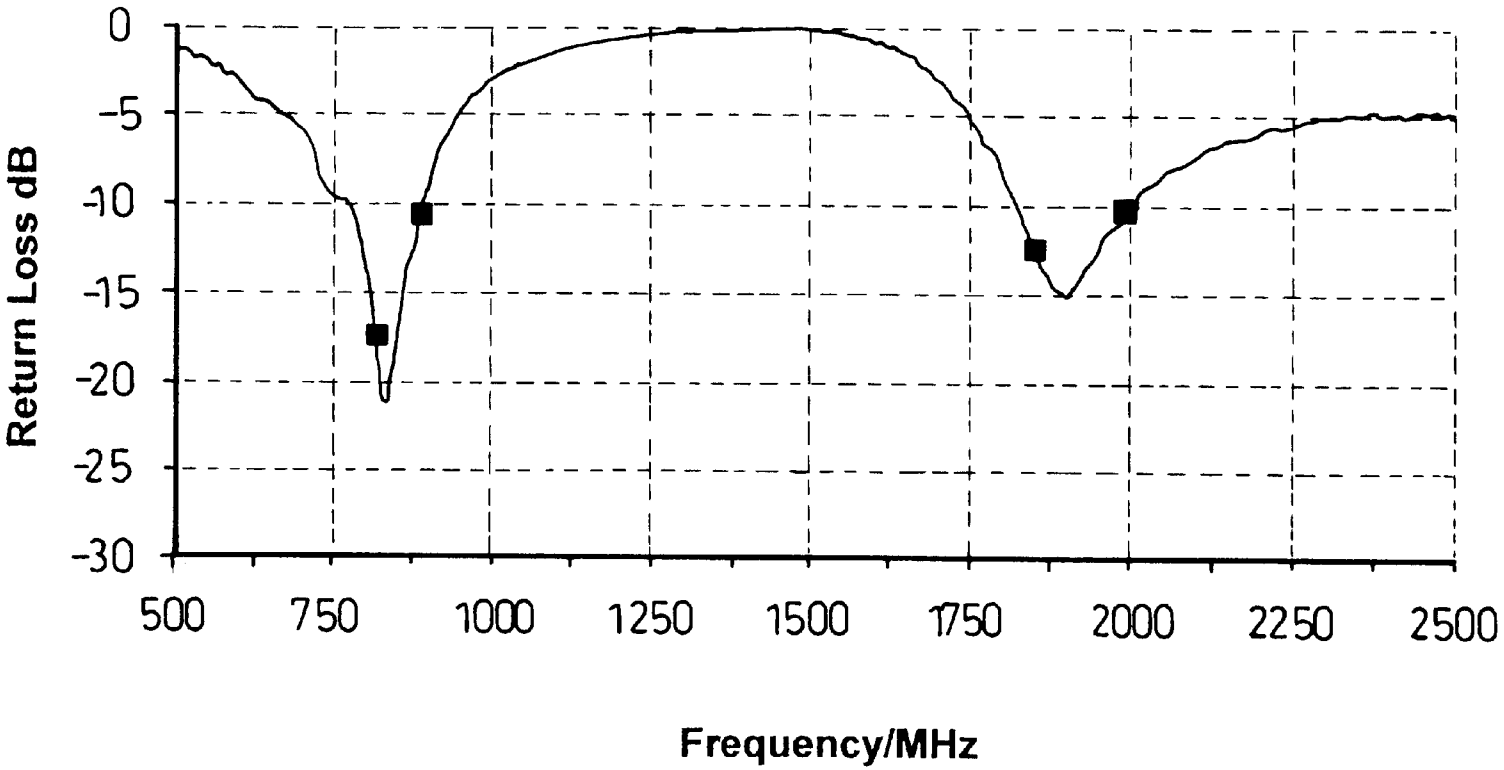
FIG. 11 shows the measured return loss for the dual frequency monopole prototype shown in FIG. 10.
Figure 12:
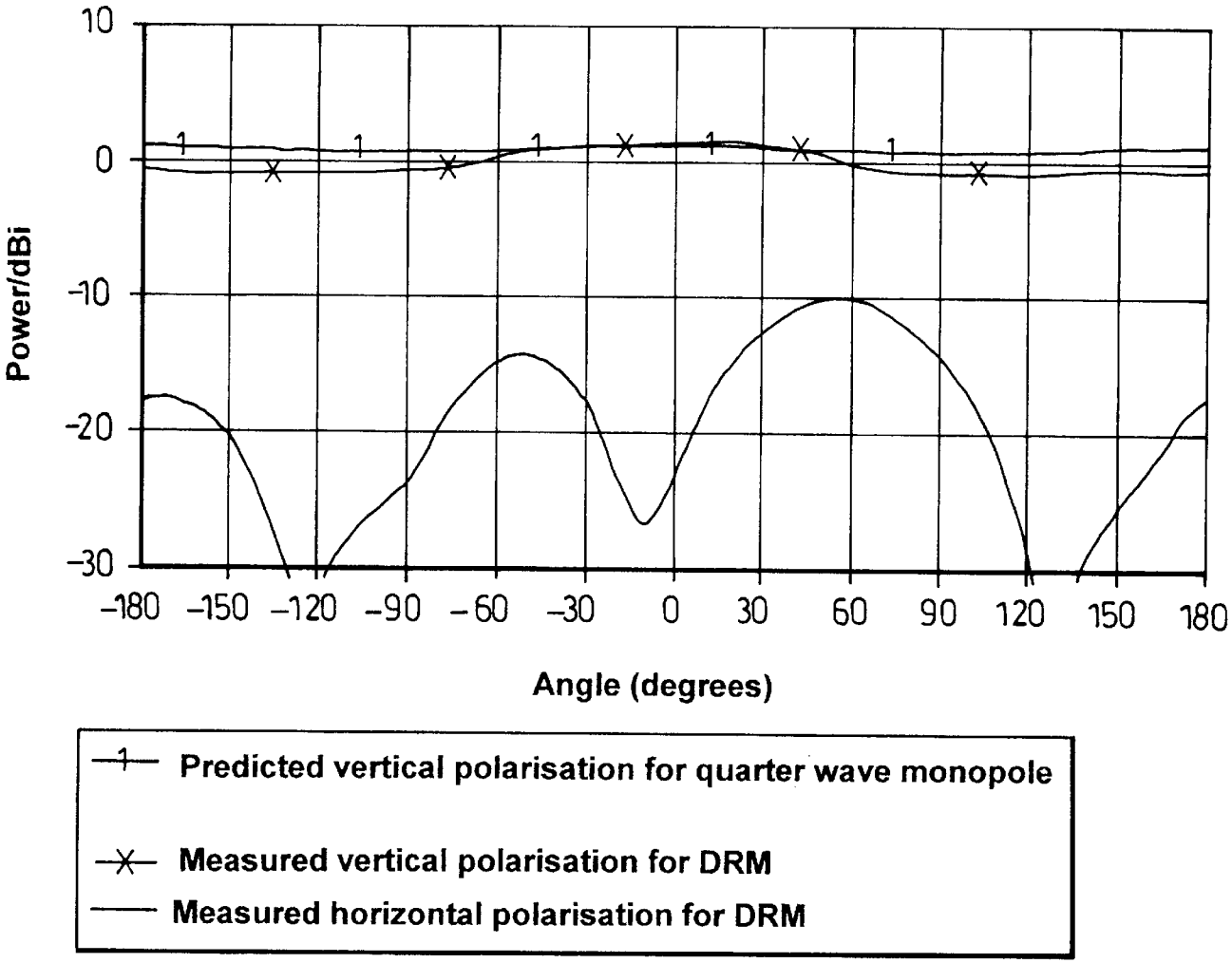
FIG. 12 shows the measured azimuth radiation pattern for the dual band monopole shown in FIG. 10 at 900 MHz.
Figure 13:
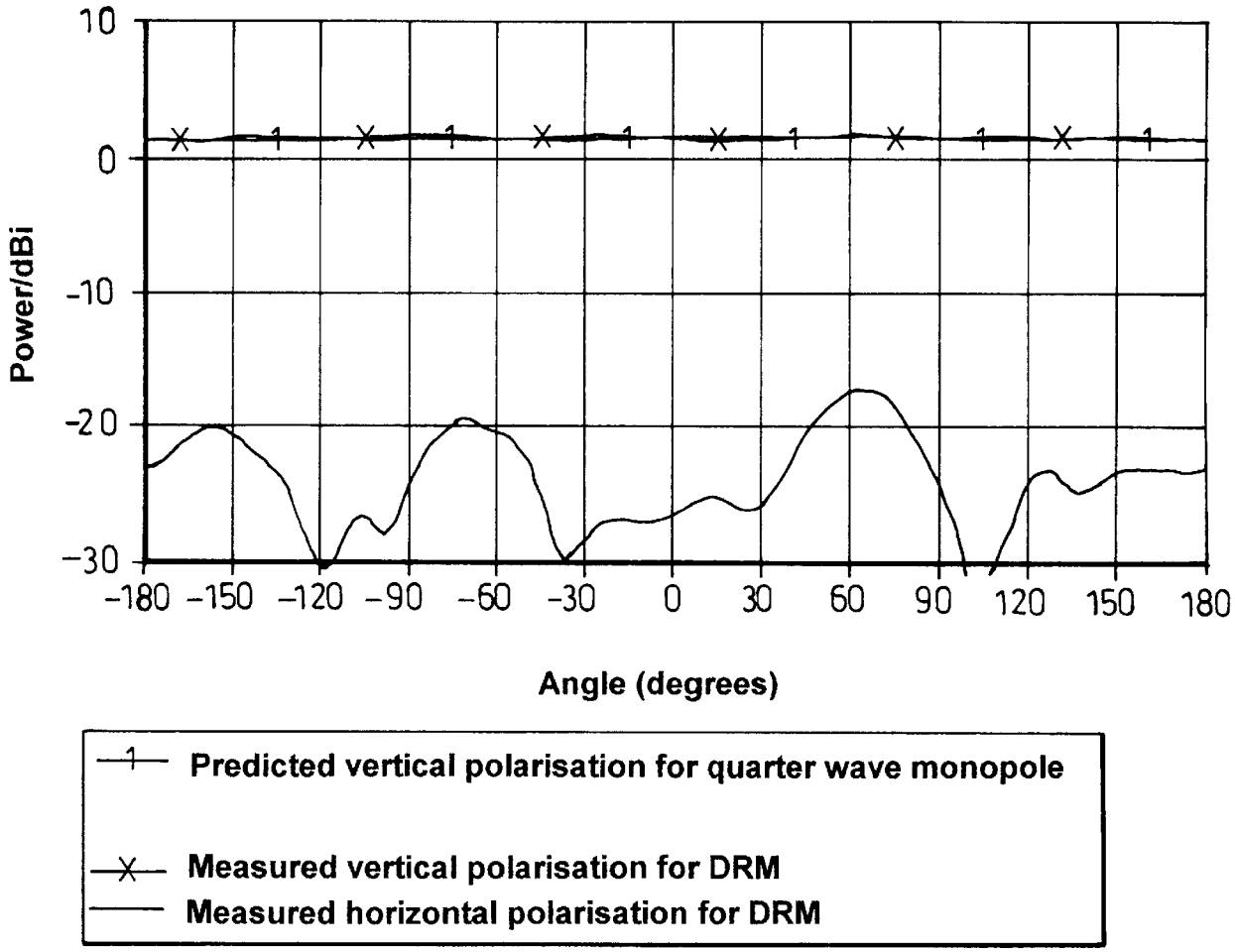
FIG. 13 shows the measured azimuth radiation pattern for the dual band monopole shown in FIG. 10 at 1900 MHz.

Equivalent performance is obtained in the azimuth pattern at both frequencies. The measured return loss is shown in FIG. 11; it can be seen that the return loss for this element is greater than 10 dB across both the AMPS band and the PCS bands. The square markers show the band limits. FIG. 12 shows predicted and measured vertical polarisation patterns for a quarter wave monopole in the same position as the dual resonance one and for the dual resonance monopole at 860 MHz. The results show that an antenna made in accordance with the invention provides equivalent performance to a quarter wavelength monopole. The azimuth pattern for the dual resonance antenna is vertically polarised and omnidirectional, with a mean gain of 0 dBi and a pattern ripple of 3.3 dB and you can see they are very close, even in the elevation plane. FIG. 13 shows the corresponding results at the higher frequency, 1920 MHz, and the difference between the predicted and measured elevation patterns is almost non-existent.

If it was desired to reduce the length of the monopole, it would be possible to coil the lower section up whereby the lower section is reduced in height. This would result in a reduction in the bandwidth available, but this is possible for certain scenarios. A suitably flexible coaxial stub could also be employed to coil the top section as well but that would have to be quite wide.

What is claimed is:

1. A dual resonance radio antenna operable at two wavelengths $\lambda_1$, and $\lambda_2$, where $\lambda_1$ and $\lambda_2$ correspond to a higher operating frequency and a lower operating frequency respectively, comprising a single feed input, a monopole element having a length corresponding to $\lambda_2/4$ and a cylindrical element comprising a coaxial stub which surrounds a length of the monopole element having an electrical length corresponding to $\lambda_1/4$, the cylindrical element being electrically connected at the top of the monopole, providing the monopole with an exposed $\lambda_1/4$ length between the coaxial stub and the single feed input to the antenna;

wherein at the lower operating frequency, current is induced on the outer surface of the coaxial stub which is in phase with the exposed $\lambda_1/4$ section and the antenna performs as a quarter wave monopole; and wherein at the higher operating frequency the coaxial stub presents a high impedance at the top of the monopole whereby the effective length of the monopole is $\lambda_1/4$, as measured from the single feed input to the antenna.

2. A dual resonance radio antenna according to claim 1 wherein the coaxial region of the stub is partially filled with a dielectric solid.

3. A dual resonance radio antenna according to claim 1 wherein the coaxial region of the stub is filled with a dielectric solid.

4. A method of operating a dual resonance radio antenna operable at two wavelengths $\lambda_1$ and $\lambda_2$, where $\lambda_1$ and $\lambda_2$ correspond to a higher operating frequency and a lower operating frequency respectively, the antenna comprising a single feed input, a monopole element having a length corresponding to $\lambda_2/4$ and a cylindrical element comprising a coaxial stub which surrounds a length of the monopole element having an electrical length corresponding to $\lambda_1/4$, the cylindrical element being electrically connected at the top of the monopole, providing the monopole with an exposed $\lambda_1/4$ length between the coaxial stub and the single feed input of the antenna;

wherein at the lower operating frequency, current is induced on the outer surface of the coaxial stub which is in phase with the exposed $\lambda_1/4$ section and the antenna performs as a quarter wave monopole; and wherein at the higher operating frequency the coaxial stub presents a high impedance at the top of the monopole whereby the effective length of the monopole is $\lambda_1/4$, as measured from the single feed input to the antenna.

* * * * *